US011262111B2

(12) United States Patent
Sävenstrand et al.

(10) Patent No.: US 11,262,111 B2
(45) Date of Patent: Mar. 1, 2022

(54) HEAT PUMP APPARATUS MODULE

(71) Applicant: ES Energy Save Holding AB, Alingsås (SE)

(72) Inventors: Fredrik Sävenstrand, Alingsås (SE); Torbjörn Assarsson, Västra Frölunda (SE); Christian Gullbrandsen, Nesbru (NO); Niklas Hansson, Alingsås (SE)

(73) Assignee: ES Energy Save Holding AB, Alingsås (SE)

( * ) Notice: Subject to any disclaimer, the term of this patent is extended or adjusted under 35 U.S.C. 154(b) by 328 days.

(21) Appl. No.: 16/317,167

(22) PCT Filed: Jul. 7, 2017

(86) PCT No.: PCT/EP2017/067057
§ 371 (c)(1),
(2) Date: Jan. 11, 2019

(87) PCT Pub. No.: WO2018/011071
PCT Pub. Date: Jan. 18, 2018

(65) Prior Publication Data

US 2019/0316819 A1 Oct. 17, 2019

(30) Foreign Application Priority Data

Jul. 12, 2016 (SE) ..... 1651043-0

(51) Int. Cl.
*F25B 30/02* (2006.01)
*F24F 1/022* (2019.01)
(Continued)

(52) U.S. Cl.
CPC ..... *F25B 30/02* (2013.01); *F24F 1/022* (2013.01); *B65D 88/745* (2013.01); *F24F 1/10* (2013.01); *F24F 12/006* (2013.01)

(58) Field of Classification Search
CPC ... F25B 30/02; F24F 1/02; F24F 1/022; F24F 1/027; F24F 1/028; F24F 1/029;
(Continued)

(56) References Cited

U.S. PATENT DOCUMENTS 1,352,533 A * 9/1920 Ross ..... F25D 11/003 62/237
3,097,587 A * 7/1963 Kurek ..... F24F 7/10 454/192
(Continued)

FOREIGN PATENT DOCUMENTS

CN 1734193 A 2/2006
CN 202993374 A 6/2013
(Continued)

OTHER PUBLICATIONS

PCT International Search Report and Written Opinion issued in corresponding PCT Application No. PCT/EP2017/067057, dated Sep. 28, 2017, pp. 1-14.
(Continued)

*Primary Examiner* — Jianying C Atkisson
*Assistant Examiner* — Miguel A Diaz
(74) *Attorney, Agent, or Firm* — Murtha Cullina LLP

(57) ABSTRACT

A heat pump apparatus module for heating and/or cooling supply water, the heat pump apparatus module including: an apparatus housing at least partly provided with an outer wall;

a heat pump arrangement including a condenser, an evaporator, and a compressor arranged between said condenser and said evaporator, said compressor configured to transfer a heat transferring medium from said evaporator to said condenser;

wherein said heat pump apparatus module is divided into at least two separate compartments being:
(Continued)

an air-flow compartment including a first heat pump component being either the condenser or the evaporator, and being configured to allow air to flow through said air-flow compartment, said first heat pump component configured to utilize said air for heating or cooling said heat transferring medium;

a first closeable compartment being accessible through a first closeable opening.

20 Claims, 5 Drawing Sheets

(51) Int. Cl.
*B65D 88/74* (2006.01)
*F24F 1/10* (2011.01)
*F24F 12/00* (2006.01)

(58) Field of Classification Search
CPC ..... F24F 1/03; F24F 1/0323; B65D 88/74; B65D 88/741; B65D 88/742; B65D 88/745; B65D 88/747; B65D 88/748; B65D 2588/74; B65D 2588/743
See application file for complete search history.

(56) References Cited

U.S. PATENT DOCUMENTS 3,100,384 A * 8/1963 Lowensohn ..... F25D 29/003 165/202
3,228,205 A * 1/1966 Franklin ..... F25D 19/003 62/237
4,272,967 A * 6/1981 White ..... B64F 1/364 62/236
4,341,088 A * 7/1982 Mei ..... B60H 1/3201 62/239
4,706,468 A * 11/1987 Howland ..... B60H 1/3232 62/199
4,736,598 A 4/1988 Sameshima et al.
5,267,448 A * 12/1993 Van Den Heuvel .. F25D 11/003 62/239
5,842,916 A * 12/1998 Gerrity ..... B07B 1/24 453/57
6,364,584 B1 * 4/2002 Taylor ..... B65D 88/022 410/121
7,765,831 B2 * 8/2010 Rodriguez ..... F25D 11/003 62/510
2008/0029529 A1 * 2/2008 Ruhl ..... B65D 90/008 220/890
2008/0060790 A1 * 3/2008 Yates ..... F16F 7/14 165/80.3
2009/0212047 A1 * 8/2009 Harman ..... B65D 90/0033 220/1.5
2009/0321041 A1 12/2009 Hammond
2011/0056651 A1 3/2011 Monk
2011/0113795 A1 * 5/2011 Montminy ..... F24F 1/022 62/77
2012/0138630 A1 * 6/2012 Kinsey, III ..... B65D 90/00 222/1
2013/0014522 A1 * 1/2013 Lukasse ..... F25D 17/042 62/93
2013/0284729 A1 * 10/2013 Cook ..... B65D 90/54 220/1.5
2015/0191305 A1 * 7/2015 Ueno ..... F25B 41/003 62/455
2015/0338135 A1 * 11/2015 Satou ..... F25D 17/042 62/228.1
2017/0234608 A1 * 8/2017 Sato ..... F25D 17/005 454/75
2018/0245835 A1 * 8/2018 Kamei ..... A23B 7/148
2018/0335219 A1 * 11/2018 Callemo ..... F24D 3/082
2018/0356135 A1 * 12/2018 Nishida ..... F25D 11/00
2019/0006984 A1 * 1/2019 Albertella ..... H02S 30/20
2019/0316819 A1 * 10/2019 Savenstrand ..... F24F 1/022
2019/0337715 A1 * 11/2019 Ramandev ..... A23B 7/0205
2020/0329037 A1 * 10/2020 Beard ..... H04L 63/0861

FOREIGN PATENT DOCUMENTS

CN 103629744 A 3/2014
CN 204629846 U 9/2015
DE 102008016577 A1 4/2009
WO 2011079371 A1 7/2011

OTHER PUBLICATIONS

CN Office Action issued in corresponding CN Application No. 201780040325.4, dated Oct. 30, 2020, pp. 1-17.

* cited by examiner

HEAT PUMP APPARATUS MODULE

TECHNICAL FIELD OF THE INVENTION

The present invention relates to a heat pump apparatus module for heating and/or cooling supply water.

BACKGROUND OF THE INVENTION

Heat pumps can be used in various applications where there is a need for either heating and/or cooling. It can for example be used for heating and/or cooling of supply water. Heat pumps which often are used are of a reversible type, meaning that they can be used for both heating and cooling. Such a heat pump arrangement does normally comprise at least an evaporator, a compressor, a condenser and an expansion valve. A heat transferring medium is normally used and pumped around through the different components of the heat pump arrangement. Depending on the direction of the heat transferring medium, the heat pump arrangement can be used for either heating or cooling.

Applications where heating and/or cooling of supply water is needed may for example be buildings but it can also be used for more non-permanent applications e.g. construction sites and/or buildings where there is a periodical or temporary need for providing supply water with a certain temperature. Heat pump modules which can be used in such non-permanent applications have to meet other requirements than permanent installations. A moveable unit that may be placed outdoors e.g. have higher requirements regarding closeable areas compared to an indoor unit. It is desired to enable a sufficient level of air-flow and at the same time provide a closeable area for protection of certain components. Such a heat pump apparatus module is described in WO13017572.

However, there exist a need for further improvements within this technical field, in order to provide heat pump modules that are both more secure and easier to use and install than the prior art, while it still has a sufficient level of air-flow to the various components.

SUMMARY OF THE INVENTION

It is an object of the present invention to improve the current state of the art and to mitigate at least some of the above mentioned problems. These and other objects are achieved by a heat pump apparatus module.

According to a first aspect of the invention a heat pump apparatus module for heating and/or cooling supply water is provided. The heat pump apparatus module comprises:

an apparatus housing being at least partly provided with an outer wall;

a heat pump arrangement comprising a condenser, an evaporator, and a compressor arranged between said condenser and said evaporator, said compressor being configured to transfer a heat transferring medium from said evaporator to said condenser;

wherein said heat pump apparatus module is divided into at least two separate compartments being:

- an air-flow compartment comprising a first heat pump component being either the condenser or the evaporator, and being configured to allow air to flow through said air-flow compartment, said first heat pump component being configured to utilize said air for heating or cooling said heat transferring medium;
- a first closeable compartment being accessible through a first closeable opening;

Thus, a compact and efficient heat pump apparatus module can be provided within an apparatus housing.

According to at least one example embodiment of the invention, the heat pump apparatus module is divided into at least three separate compartments, wherein said third separate compartment is:

- a second closeable compartment being accessible through a second closeable opening, said second closeable compartment comprising connecting ports for the supply water and electrical connections for at least driving the compressor.

Thus, in other words, said heat pump apparatus module is divided into at least three separate compartments being:

- the air-flow compartment comprising a first heat pump component being either the condenser or the evaporator, and being configured to allow air to flow through said air-flow compartment, said first heat pump component being configured to utilize said air for heating or cooling said heat transferring medium;
- the first closeable compartment being accessible through a first closeable opening;
- the second closeable compartment being accessible through a second closeable opening, said second closeable compartment comprising connecting ports for the supply water and electrical connections for at least driving the compressor.

The present invention is based on the realization that a complete, versatile, compact and efficient heat pump apparatus module can be provided within an apparatus housing. The heat pump apparatus module may work as a climate management system for e.g. buildings and/or construction sites. By dividing the heat pump apparatus module into at least two or three separate compartments, that is the air-flow compartment, the first closeable compartment, and optionally the second closeable compartment desired functionalities are achieved. Simultaneously, the air-flow compartment allows air to flow through the air-flow compartment to achieve a high efficiency of the heat pump arrangement. Moreover, the first and the second closeable compartment allows for simple use and maintenance e.g. by allowing different levels of access for users and service technicians. The first and/or the second closeable compartment allows quick installation of the module and/or facilitates connection to the supply water provided from the heat pump apparatus module.

According to at least one example embodiment the heat pump apparatus comprises a first heat pump component and a second heat pump component. The first heat pump component may be either the condenser or the evaporator. The second heat pump component may be the other one of the condenser and the evaporator. According to at least one example embodiment of the invention the first heat pump component and the second heat pump component may be arranged in the air-flow compartment. Hence, both the condenser and the evaporator may be arranged in the air-flow compartment. According to at least one example embodiment the first heat pump component and the second heat pump component configured as one unit, such unit may comprise a complete heat pump arrangement. According to another example embodiment of the invention the first heat pump component may be arranged in the air-flow compartment and the second heat pump component may be arranged in the first closeable compartment. Hence, either the condenser or the evaporator will be arranged in the air-flow compartment and the other one of the condenser and the evaporator will be placed in the first closeable compartment.

It should be understood that the heat pump arrangement is a complete heat pump arrangement comprising the necessary equipment for carrying out the function of the heat pump working with transferring heat from air to a liquid, such as inter alias: evaporator, condenser, compressor, expansion valve and piping. Moreover, it shall be understood that the first and second heat pump components are typically not physically replaced with each other, but the function of the respective first and second heat pump components are decided based on the desired direction of transferring heat. That is, it is merely the direction of operation of the heat pump arrangement which decides whether the first heat pump component is acting as the evaporator and the second heat pump component is acting as the condenser or vice versa. Hence, it is the direction of operation of the heat pump arrangement that decides whether the heat pump apparatus module is used for heating or cooling of supply water. In other words, the same heat pump apparatus module can be used for both heating and cooling of supply water.

It should be understood that supply water can be e.g. tap water and radiator water for heating and/or cooling of buildings.

According to at least one example embodiment of the invention the apparatus housing being at least partially provided with an outer wall means that the outer wall surrounds the first closeable compartment or the first and the second closeable compartments. According to at least another exemplary embodiment the outer wall surrounds also the air-flow compartment or parts of the air-flow compartment.

It should be understood that the outer wall surrounding the first and/or the second closeable compartments may be a solid wall or it may be a lattice and/or grating. The lattice and/or grating is configured such that there are no possibilities for a person to access the first and/or the second closeable compartment without using the first or the second closeable opening.

According to at least one example embodiment of the invention the outer wall covering the first and the second closeable compartments may be different from each other. Moreover, if the outer wall is surrounding the air-flow compartment the outer wall may here be different from the outer wall covering the first and/or the second closeable compartment. For example, the first and/or the second closeable compartments may be covered by a solid wall and the air-flow compartment may be covered by a lattice and/or grating. Moreover, if a lattice and/or grating is used, the holes of the lattice and/or grating covering the separate compartments may be of different size.

According to at least one example embodiment of the invention there are an inner wall or inner walls dividing the separate compartments, e.g. there is an inner wall dividing the air-flow compartment from the first closeable compartment and/or there is an inner wall dividing the first closeable compartment from the second closeable compartment. Depending on the specific configuration of the heat pump apparatus module, the air-flow compartment may be adjacent to one or to both of the two closeable compartments, and then also be separated from each one of them by inner walls. The inner wall or inner walls may be solid and/or they may be made from a lattice and or grating.

According to at least one example embodiment of the invention the separate compartments being closeable may mean that they are lockable. The separate compartments may be locked in order to prevent unauthorized persons to enter the separate compartments.

According to at least one example embodiment of the invention the heat pump apparatus module further comprises a third heat pump component. The third heat pump component may be placed either in the air-flow compartment or in the first closeable compartment. The third heat pump component may for example be a condenser or an evaporator. According to at least one example embodiment, the heat pump apparatus module comprises more than three heat pump components, such as e.g. five or ten heat pump components.

Thus, according to at least one example embodiment of the invention the heat pump arrangement may comprise one or several evaporators. Hence, the heat pump arrangement may comprise at least one evaporator, or at least two evaporators, or at least three evaporators, or at least five evaporators, or at least ten evaporators.

According to at least one example embodiment of the invention the heat pump arrangement may comprise one or several condensers. Hence, the heat pump arrangement may comprise at least one condenser, or at least two condensers, or at least three condensers, or at least five condensers, or at least ten condensers.

According to at least one example embodiment, the third heat pump component is connected in series and/or in parallel with the first heat pump component and/or the second heat pump component.

For example, if the first heat pump component is an evaporator arranged in the air-flow compartment, and the second heat pump component is a condenser arranged in the first closeable compartment, the third heat pump component is preferably an evaporator or an intermediate heat exchanger arranged in the first closeable compartment. According to at least one example embodiment, different heat transfer mediums may be used in the first and third heat pump components, respectively.

Thus, according to at least one example embodiment of the invention the at least two evaporators can be connected in series and/or in parallel with each other.

According to at least one example embodiment, one or more of the evaporators may be connected to one or more of the condensers. For example, the heat pump arrangement may comprise four to twelve evaporators and only two to six, condensers.

According to at least one example embodiment of the present invention the at least two condensers can be connected in series and/or in parallel with each other.

By connecting the condensers and/or evaporators in series with each other different heat transferring mediums can be used in the respective condenser and/or evaporator and thereby a higher temperature increase and/or lower temperature decrease of the heat pump arrangement can be achieved, i.e. the heat pump apparatus module may be used for another temperature interval if connecting several condensers and/or evaporators in series.

According to at least one example embodiment of the invention the heat pump apparatus module may comprise two or more heat pump arrangements. The two or more heat pump arrangements may be connected in parallel or in series with each other. Having the heat pump arrangement in parallel will provide the heat pump apparatus module with a higher capacity, i.e. more supply water and/or more energy can be provided, or a higher temperature increase can be achieved. According to at least one example embodiment of the invention, when the two or more heat pump arrangements are connected in series and/or parallel, different heat transferring mediums can in addition be used in order to achieve high-grade heat, i.e. to achieve a higher temperature of the supply water. According to at least one example embodiment of the invention, when the two or more heat pump arrangements are connected in series and/or parallel, different heat transferring mediums can in addition be used in order to achieve high-grade cooling, i.e. to achieve a lower temperature of the supply water. Moreover, having the heat pump arrangements connected in series may result in a higher capacity of the heat pump modulus. According to at least one example embodiment of the invention, the heat pump arrangement can be connected in series with another type of heat pump arrangement, e.g. a liquid-water heat pump arrangement.

According to at least one example embodiment of the invention the heat pump arrangement further comprises an expansion valve. The expansion valve may be located between the condenser and the evaporator for lowering the pressure of the heat transferring medium. According to at least one example embodiment of the invention additional valves can be used. According to at least one example embodiment, the expansion valve is arranged inside the first closeable compartment. Moreover, the expansion valve is not exposed to the outdoor environment. However, according to at least one alternative example embodiment, the expansion valve is arranged inside the air-flow compartment.

According to at least one example embodiment of the invention, the heat pump apparatus module further comprises various types of pipes and/or piping. The various types of pipes and/or piping may connect the different parts and components of the heat pump arrangement. Moreover, the various types of piping fluidly connect the separate compartments of the heat pump apparatus module. According to at least one example embodiment of the invention the heat pump apparatus module further comprises one or several heat exchangers. The one or several heat exchangers may further increase the temperature of the supply water, and/or be heat exchanged with any one of the heat pump components. For example, the second heat pump component being e.g. a condenser may be heat exchanged with a heat exchanger comprising the supply water, thus, the heat transferring medium inside the evaporator transfers the heat to the supply water in the heat exchanger. The one or several heat exchangers may e.g. be arranged inside the first closeable compartment. According to at least one example embodiment of the invention, the heat pump apparatus module further comprises one or several tanks, such as e.g. one or several water tanks. The tanks can store both warm and/or cold water and/or another liquid. Moreover, the tanks can be used for storage of excess energy. The excess energy may be stored as heat transferring medium, heat receiving medium and/or supply water. The one or several tanks may e.g. be arranged inside the first closeable compartment.

According to at least one example embodiment of the invention the water tank containing warm water may comprise water coils, in which water coils cold water is flowing. In this way, the warm water inside the tank is used for heating the cold water in the water coils, i.e. the set up works as a heat exchanger. According to at least one example embodiment the water tanks may contain cold water. The cold water may then be used for cooling water inside the water coils. According to at least one example embodiment of the invention the heat pump apparatus module may further comprise one or several heat exchangers.

According to at least one example embodiment of the invention the water tanks may be provided with an immersion heater or another type of heater which may be provided inside the water tanks. Such immersion heater or other type of heater may be used in order to heat the water inside the tanks and/or the water inside the water coils.

According to at least one example embodiment a heat transferring medium is heat exchanged with a heat receiving medium in the condenser. According to at least one example embodiment of the invention accumulated heat receiving medium may be stored in water tanks, which water tanks may be used for further heat transferring as described herein. According to at least one example embodiment of the invention the heat receiving medium may be supply water, e.g. tap water and/or radiator water. According to another example embodiment of the invention the heat receiving medium may be so called dead water, e.g. water without oxygen in a gaseous form and/or water which may be mixed with glycol. According to at least one example embodiment the heat receiving medium may later be heat exchanged again for heating water in an additional heat exchanger and/or the water tanks. This water may be used as tap water and/or radiator water. According to at least one example embodiment of the invention the dead water may be used as radiator water.

According to at least one example embodiment of the invention the heat pump apparatus module further comprises a control system. The control system may be used for controlling the temperature of the supply water. According to at least one example embodiment of the invention the control system may be wirelessly controlled by software such as e.g. an app which can be used for controlling the temperature externally. According to at least one example embodiment of the invention the app may be used for controlling other parameters relating to indoor climate such as e.g. relative humidity externally or concentration of oxygen or other gases. According to at least one example embodiment, the control system is responsive to a heating or cooling demand in e.g. a building, and thus is configured to control the heat pump apparatus module in such a way that the demand is met.

According to at least one example embodiment, the heat pump apparatus module further comprises a top-load arrangement for supplying additional heating or cooling when the demand of heating or cooling is higher than the capacity of the heat pump arrangement. The top-load arrangement may e.g. comprise a heater, such as an electrical heater connected to a water tank, connection ports to district heating, or a boiler (e.g. oil or bio-fuel driven). The top-load arrangement is preferably arranged inside the first closeable compartment.

According to at least one example embodiment of the invention, the separate compartments are physically separated compartments implying that the compartments are physically separated by e.g. walls, the walls may however comprise connections for piping which fluidly connects the separated compartments through said piping. It should be understood that physically separated is indicating that the at least three different compartments are not accessible in such a way that a person can access one separate compartment from another. According to at least one example embodiment of the invention the first closeable compartment is being independent from the second closeable compartment and the air-flow compartment. Hence, a human cannot access the first closeable compartment from any of the other compartments. The first closeable compartment is being accessible through a first closeable opening.

According to at least one example embodiment of the invention there are closeable doors, which can be opened, provided between at least two of the separate compartments such that a person can access one separate compartment from another.

According to at least one example embodiment of the invention the air-flow compartment is closeable but not closed, i.e. the outer wall surrounding the air-flow compartment is not allowing un-authorized persons to enter the air-flow compartment but the outer wall is not a solid wall so that air is continuously allowed to flow through the compartment. According to at least one example embodiment of the invention the air-flow compartment does have an opening or openings covering a substantial part of the outer wall surrounding the air-flow compartment. The opening or openings allows the air to flow through the air-flow compartment and hence a large amount of air can flow through the air-flow compartment.

According to at least one example embodiment of the invention the first and/or the second closeable compartments may be both closeable and closed. According to at least one example embodiment the air-flow compartment can be surrounded by a wall with relative smaller openings allowing for a forced air-flow to flow there-through. The air-flow may be forced by e.g. a ventilation system or an external fan/compressor.

According to at least one example embodiment of the invention the first closeable compartment and/or the second closeable compartment are isolated. Hence, this compartment may be referred to as an isolated, or heat-insulated, first closeable compartment. By isolation the first closeable compartment the inner temperature may be adapted to be above the freezing point of water. This means that the supply water in the tanks and/or piping does not freeze. Moreover, an isolated first closeable compartment and/or second closeable compartment may facilitate for installation, commissioning and/or maintenance work as the service technician can work in a comfortable, or at least not freezing, temperature. Moreover, the closeable compartments may provide protection of components of the heat pump arrangement from weather conditions, which may be harmful for the components of the heat pump arrangement.

According to at least one example embodiment of the invention the second closeable compartment is being independent from the first closeable compartment and the air-flow compartment. Hence, a human cannot access the second closeable compartment from any of the other compartments. Thus, according to one example embodiment, the first closeable compartment is separated from the second closeable compartment by an inner wall in the housing. However, according to at least one example embodiment, the second closeable compartment is accessible via the first closeable compartment by means of a closeable opening in the inner wall. This closeable opening is preferably lockable. The second closeable compartment is being accessible from an outside of the heat pump apparatus module through a second opening.

According to at least one example embodiment of the invention the first closeable opening and/or the second closeable opening may be arranged in the outer wall. According to another example embodiment the first closeable opening and/or the second closeable opening may be arranged in the inner wall or inner walls separating the compartments. According to at least one example embodiment the first closeable compartment may be accessible through a first closeable opening in the outer wall or through a first closeable opening in the inner wall dividing the first closeable compartment from the air-flow compartment. According to at least one example embodiment of the invention the second closeable compartment is accessible through a second closeable opening in the outer wall or a second closeable compartment in the inner wall dividing the first closeable compartment from the second closeable compartment or a second closeable opening in the inner wall dividing the air-flow compartment from the second closeable compartment.

According to at least one example embodiment of the invention there may be a third closeable opening through which the air-flow compartment may be accessed. The third closeable opening may be arranged in the outer wall or in the inner wall dividing the first closeable compartment and the air-flow compartment or in the inner wall dividing the second closeable compartment and air-flow compartment.

According to at least one example embodiment of the invention said compressor is arranged in said first closeable compartment.

According to at least one example embodiment of the invention, having the compressor in the first closeable compartment may decrease the sound level outside the first closeable compartment, that is the external sound or noise from the heat pump apparatus module may be decreased. Furthermore, excess energy from the compressor during operation may be used for increasing the temperature inside the first closeable compartment without need for external heat sources, or at least with a decreased need for external heat sources. Furthermore, having the compressor in the first closeable compartment may facilitate maintenance work. Moreover, it may give more free space in the air-flow compartment and hence not hinder any air flowing there-through.

According to at least one example embodiment of the invention, having the compressor in the first closeable compartment may decrease the amount of electricity connections/components needed in the air-flow compartment. Hence, most of the electricity needed for the heat pump apparatus may be in the first closeable compartment which preferably is above freezing temperature of water and thus has an adapted indoor environment causing less equipment fatigue and a reduced risk for electricity hazards. By this decrease of electricity needed in the air-flow compartment the heat pump apparatus may be suitable for off-shore applications. According to at least one example embodiment of the invention having the compressor in the first closeable compartment may protect it and the electronic equipment which is connected to the compressor from weather conditions which may for example occurs off-shore.

According to at least one example embodiment of the invention the compressor is arranged in the air-flow compartment. This may allow for the air flowing through the air-flow compartment to cool the compressor and thereby decreasing the risk for the compressor to become overheated. Moreover, having the compressor in the air-flow compartment may give more space for other components, such as tanks, piping, heat exchangers etc. in the first closeable compartment. Further, having the compressor in the air-flow compartment reduces the sound level in the first closeable compartment.

According to at least one example embodiment of the invention said first heat pump component is the evaporator, thereby enabling said supply water to be heated by said heat pump arrangement.

In other words, the heat pump apparatus module is configured to satisfy a heating demand from e.g. a building or a construction site.

According to at least one example embodiment of the invention said first heat pump component is the condenser, thereby enabling said supply water to be cooled by said heat pump arrangement.

In other words, the heat pump apparatus module is configured to satisfy a cooling demand from e.g. a building or a construction site.

According to at least one example embodiment of the invention the heat pump apparatus module is configured to be switched between heating and cooling the supply water without the need for physically re-arrange the first heat pump component with the second heat pump component. In other words, the first heat pump component and the second heat pump component are configured to act as either one of a condenser and evaporator. Thus, simply, the direction of operation of the heat pump arrangement decides however the heat pump apparatus module is used for heating or cooling of supply water. In other words, the heat pump apparatus module may sequentially provide heated or cooled supply water.

According to at least one example embodiment of the invention the two or more heat pump arrangements can be used separately. In other words, one heat pump arrangement can be used for heating supply water while the other heat pump arrangement(s) may simultaneously be used for cooling supply water. According to at least one example embodiment, the second closeable compartment comprises connections for both heated and cooled supply water.

According to at least one example embodiment of the invention said air-flow compartment is configured to enable an air flow of at least 1000 $m^3$/h, or at least 10000 $m^3$/h, or at least 20000 $m^3$/h, through said air-flow compartment.

According to at least one example embodiment of the invention the air-flow compartment and the corresponding air flow there-through is adapted to the capacity of the heat pump apparatus module. According to at least one example embodiment, an air-flow of 6000 $m^3$/h-7500 $m^3$/h corresponds to a heat pump apparatus module of 20 kW and an air-flow of 24000 $m^3$/h-30000 $m^3$/h corresponds to a heat pump apparatus module of 80 kW.

According to at least one example embodiment of the invention it should be understood that the outer wall may be a solid wall when surrounding the first and second closeable compartment. It should moreover be understood that the outer wall may be an open wall when surrounding the air-flow compartment, i.e. the outer wall surrounding the air-flow compartment comprises one or several openings which allows for air flowing through the compartment. The outer wall surrounding the air-flow compartment may also be a solid wall allowing for a forced air-flow through the air-flow compartment using a ventilation system.

According to at least one example embodiment of the invention at least a portion of the outer wall surrounding said air-flow compartment is comprised of a lattice or grating enabling air to flow there-through.

The lattice or grating may hinder debris to enter the air-flow compartment without greatly reducing or hindering the air flowing through the air-flow compartment. Moreover, the lattice or gratings may hinder any unauthorized human to enter the air-flow compartment.

According to at least one example embodiment of the invention said heat pump apparatus module is configured to automatically remove any debris attached to said lattice or grating.

According to at least one example embodiment of the invention the heat pump apparatus module comprises a control system which is programmed for reversing the air flow of the first heat pump component for a predetermined time interval in order to remove any debris attached in the lattice or grating. The reversed air flow is used for blowing the debris away after having been sucked onto the lattice or grating. Removing the debris enables operational air flow through the air-flow compartment.

According to at least one example embodiment of the invention the heat pump apparatus module comprises an additional air blow-system which may be used in order to remove debris by blowing the debris away from the lattice or grating.

According to at least one example embodiment of the invention the heat pump apparatus module comprises scrapers which are configured for removing debris from the lattice or grating. The scrapers may e.g. be connected to a motor or actuator which is run intermittently in order for the scraped to be swiped over the lattice or grating at given time intervals. According to at least one example embodiment of the invention, the motor or actuator may be powered by wind power.

According to at least one example embodiment of the invention debris can be removed manually from the lattice or grating.

According to at least one example embodiment of the invention said air-flow compartment comprises an air-intake portion and an air-outlet portion, configured such that air flowing through said air-flow compartment is brought into contact with said first heat pump component, said heat pump apparatus module further comprising an air-recirculation reducing arrangement configured to prevent or at least reduce, outlet air from the air-outlet portion to be mixed with inlet air in the air-intake portion. By preventing or at least reducing the outlet air from the air-outlet portion to be mixed with the inlet air in the air-intake portion the efficiency of the heat pump arrangement is increased.

According to at least one example embodiment of the invention the air-recirculation reducing means may be at least one guiding plate which is configured to prevent or at least reduce outlet air from the air-outlet portion to be mixed with inlet air in the air-intake portion. According to at least one example embodiment of the invention the air-recirculation reducing means may be a combination of a lattice or a grating and at least one guiding plate.

According to at least one example embodiment of the invention the guiding plate may be arranged horizontally in order to force the outlet air downwards. According to at least one example embodiment of the invention the guiding plate may be arranged vertically.

According to at least one example embodiment the air-recirculation means may be divided into an air-intake portion and an air-outlet portion. The air-intake portion may be a lattice or a grating. The air-outlet portion may be at least one guiding plate.

According to at least one example embodiment the outlet air is prevented from mixing with the inlet air by the placement of the first heat pump component. The first heat pump components may be placed with an off-set angle relative each other in order to prevent or at least reduce outlet air from the air-outlet portion to be mixed with inlet air in the air-intake portion.

According to at least one example embodiment of the invention the air-recirculation reducing arrangement comprises an air-recirculation reducing wall arranged to separate said air-outlet portion and said air-intake portion.

According to at least one example embodiment of the invention said air-recirculation reducing wall at least partially surrounds said air-flow compartment; and wherein said air-intake portion is an opening in said air-recirculation reducing wall.

According to at least one example embodiment of the invention, said heat pump apparatus module further comprises a duct provided for transporting exhaust gas from a house or a building; and wherein said at least one opening in said air-recirculation reducing wall is a duct facing opening and wherein said duct is arranged in front of and/or in close proximity of said duct facing opening. This allows for using the heat pump apparatus module for heat recovery.

Stated more generally and according to at least one example embodiment of the invention, the air-flow compartment may be at least partially surrounded by a wall with a relative small opening or relative small openings. According to some embodiments a duct is arranged adjacent to, or in close proximity to, the apparatus housing. The opening of the duct may be arranged in front of the opening, being e.g. a duct facing opening, of the wall at least partially surrounding the air-flow compartment. Through the duct, warm exhaust air from a house or a building is transported and guided through the duct facing opening of the outer wall surrounding the air-flow compartment. This allows for using the heat pump apparatus module for heat recovery.

According to at least one example embodiment of the invention, in which embodiments the heat pump apparatus module is used for cooling of the supply water, the duct and/or the heat pump apparatus module may comprise an arrangement for guiding the exhaust air transported through the duct away from the opening, e.g. the duct facing opening, of the outer wall surrounding the air-flow compartment.

According to at least one example embodiment of the invention the wall arranged to separate said air-outlet portion and said air-intake portion is a wall at least partly surrounding said air-flow compartment, wherein said wall comprises holes or openings corresponding to said first heat pump component. Additionally, or alternatively, the wall is a part of another wall which is at least partially surrounding the air-flow compartment.

According to at least one example embodiment of the invention the heat pump apparatus module further comprising a drainage system for removing moisture originating from an outer surface of said first heat pump component to outside of said air-flow compartment.

According to at least one example embodiment of the invention the removal of moisture originating from an outer surface of the first heat pump component prevents or at least reduces the amount of ice that may form on the outer surface of the first heat pump component.

According to at least one example embodiment of the invention the heat pump apparatus module further comprising an ice reducing arrangement for hindering ice to form on the outer surface of the first heat pump component. The ice reducing arrangement may for example be a heater placed adjacent to said outer surface of the first heat pump arrangement, or it can be a heated wire. Further, the ice reducing arrangement may be piping, e.g. the return pipe from the first heat pump component, arranged in such manner that heated heat transferring medium may prevent or at least reduce the amount of ice that may form on the outer surface of the first heat pump component. Furthermore, the ice reducing arrangement may comprise placing the compressor in the air-flow compartment and to use the excess heat from the compressor in order to prevent or at least reduce the amount of ice that may form on the outer surface of the first heat pump component. Moreover, the ice reducing arrangement may be a device which may transfer heat to places where ice normally may form and directs the meltwater away from the heat pump arrangement, e.g. pipes with heated water or heat transferring medium flowing inside.

According to at least one example embodiment of the invention said first closeable compartment is accessible through a first level of access, and wherein said second closeable compartment is accessible through a second level of access being different to said first level of access.

According to at least one example embodiment of the invention having a first and a second level of access allows for authorizing different persons for entering the first and second closeable compartment. For example, the persons that only are using the supply water shall only be authorized for entering the second closeable compartment, whereas the persons working with maintenance of the heat pump arrangement should have authorization for entering the first closeable compartment. According to at least one example embodiment of the invention the first and second levels are parallel levels of access. According to at least one example embodiment of the invention the first and second level is the same level of access. According to at least one example embodiment, the level of access to the first closeable compartment is a higher level of security compared to the level of access to the second closeable compartment. For example, a person, such as a service technician, has access to the first closeable compartment as well as to the second level of compartment, in order to have access to any equipment in need of maintenance, while a person, such as a person connecting the supply water and/or electricity to the heat pump apparatus module, only has access to the second closeable compartment.

It should be noted that also the air-flow compartment may be accessible with a certain level, i.e. a third level of access, e.g. by means of a lockable opening in the outer wall, or in an inner wall separating the first closeable compartment with the air-flow compartment. In this way the air-flow compartment is only accessible for authorized persons, such as service technicians. The third level of access may be different from both the first and the second level of access, or it may be the same as either the first and/or the second level of access. According to at least one embodiment of the invention there may be several openings to the separate compartment, which several openings relates to different levels of access.

According to at least one example embodiment of the invention the openings between the separate compartments, e.g. an opening in the inner wall between the air-flow compartment and the first closeable compartment and/or the second closeable compartment, may have a level of access which may be the same as the first and/or second level of access or which may be third or fourth or fifth level of access.

According to at least one example embodiment of the invention, said first level of access is associated with a first security level, and said second level of access is associated with a second security level different from said first security level, thereby authorizing persons with different level of security access to enter the first and the second closeable compartments, respectively. For example, said first and said second security level may be a first and a second lock, wherein the first lock is different from said second lock, i.e. the first and the second locks are openable with different keys. The respective first and second locks and associated keys may be conventional mechanical locks and keys, or may e.g. be digital locks and keys wherein the respective digital key is integrated into a software, e.g. in a mobile phone.

According to at least one alternative embodiment of the invention, the first and the second security levels may be the same. For example, the first and the second lock may use the same or different keys.

According to at least one example embodiment of the invention said apparatus housing is container of standardized dimension, such as e.g. a shipping container or an ISO container. It may be understood that a ISO container is a container having dimensions according to ISO 668:2013. In other words, the apparatus housing may be a container having dimensions as defined by ISO 668:2013 as it is written at the date of filing this application or at the priority date of the application.

According to at least one example embodiment of the invention the apparatus housing being a container of standardized dimensions are allowing for having the heat pump apparatus module to be transported in its own housing. A standardized container has standard outer dimensions which allows for transporting and/or handling the heat pump apparatus module on e.g. trucks, boats and/or trains.

According to at least one example embodiment of the invention the transport of the heat pump apparatus module is from where the heat pump apparatus module has been built to the first customer, but also between customers.

According to at least one example embodiment of the invention the container may be chosen from a list comprising, but not limited to: an intermodal container, a cargo container, a freight container, or an ISO container, or a US standard container.

According to at least one example embodiment of the invention the container can have two different standard outer dimensions. The length of the container can hence from 8 ft to 45 ft, or it can be from 15 ft to 30 ft. The length of the container used can be 8 ft, or 10 ft, or 15 ft, or 20 ft, or 30 ft, or 40 ft, or 45 ft. The dimensions of the container may determine the number of evaporators and/or the number of condensers comprised in the heat pump arrangement. Hence, the dimensions of the container may determine the capacity of the heat pump apparatus module. According to at least one example embodiment the container can be of standard height. According to another example it may be a high cube (HQ or HC) container.

According to at least one example embodiment the width of the container is 8 ft.

According to at least one example embodiment of said invention the height of the container is 8 ft and 6 inches, or it is 9 ft and 6 inches.

According to at least one example embodiment of the invention, the apparatus housing is a container having a length, a width and a height; wherein the length of said container is between 8 ft and 45 ft, or between 10 ft and 40 ft, or between 20 ft and 40 ft; and/or wherein the width of said container is between 8 ft and 10 ft; and/or wherein the height of said container is between 8 ft and 10 ft.

According to at least one alternative embodiment of the invention, the apparatus housing may be a customized module comprising at least two, or at least three compartments. Such a customized module may be of dimensions which are the same or different from the standardized dimensions as described above.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF THE DRAWINGS

Figure 1:
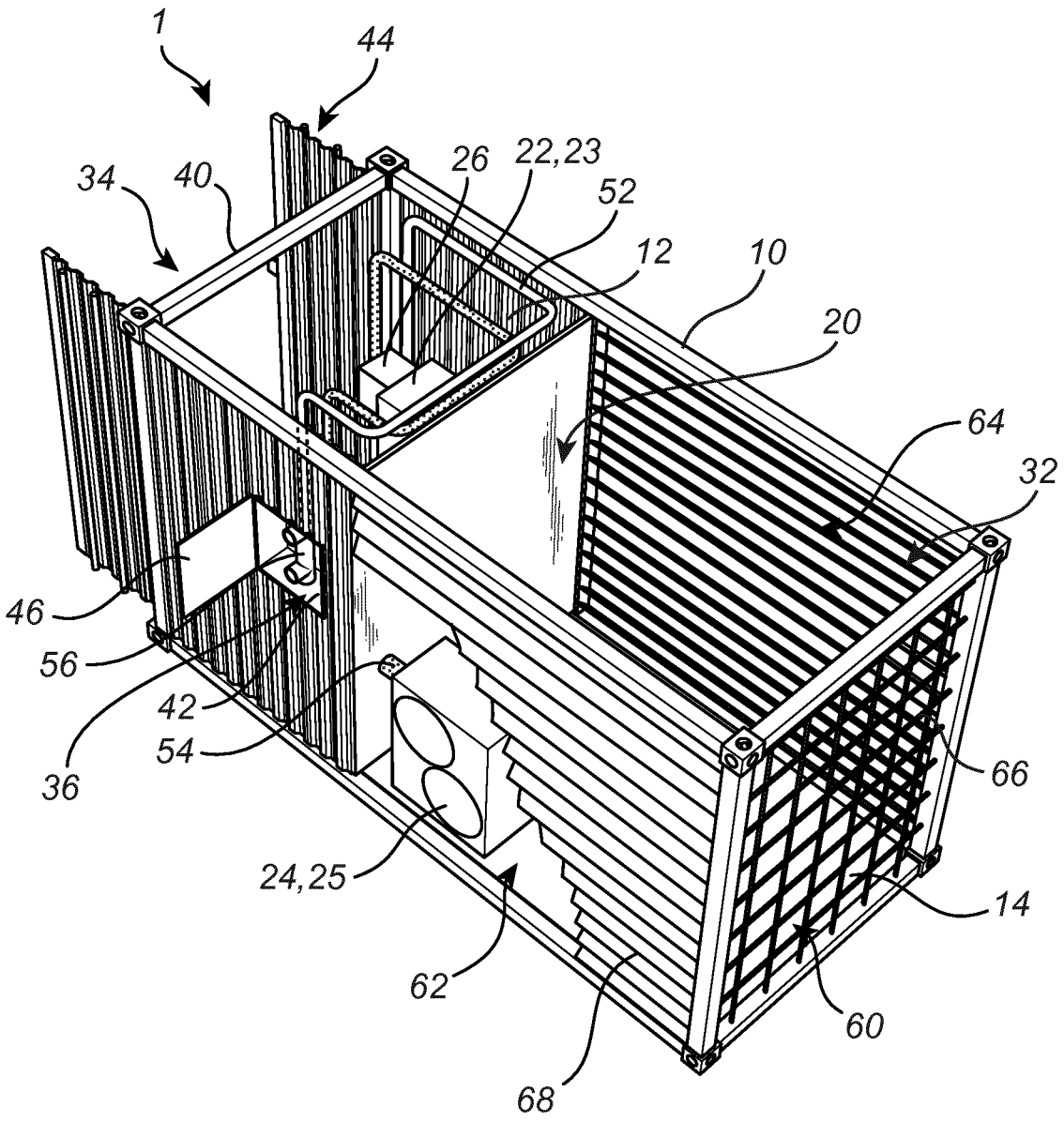
FIG. 1 is a schematic, perspective view of a heat pump apparatus module in accordance with at least one embodiment of the invention.

FIG. 1 shows a heat pump apparatus module 1 for heating supply water led through piping 52 to a connecting port 56 in accordance with one embodiment of the present invention. The heat pump apparatus module 1 comprises an apparatus housing 10, here shown as a shipping container 10 (may also be referred to as an intermodal container, or a cargo container, or a freight container, or an ISO container, or an US standard container). The apparatus housing 10 has an outer wall 12. The heat pump apparatus module 1 further comprises a heat pump arrangement 20 that comprises a condenser 22, an evaporator 24, and a compressor 26. The compressor 26 is arranged between the condenser 22 and the evaporator 24.

The heat pump apparatus module 1 is divided into three separate compartments 32, 34, 36:

- An air-flow compartment 32 which comprises a first heat pump component 25. In the embodiment of FIG. 1 the first heat pump component 25 corresponds to the evaporator 24.
- A first closeable compartment 34 which is accessible through a first closeable opening 40 in the outer wall 12. In FIG. 1, the first closeable opening 40 is closeable by the container doors 44. The first closeable compartment 34 comprises a second heat pump component 23, which in the embodiment of FIG. 1 corresponds to the condenser 22. Further, the heat pump apparatus module comprises a compressor 26, wherein the compressor is arranged in said first closeable compartment
- An optional second closeable compartment 36 which is accessible through a second closeable opening 42 in the outer wall 12. The second closeable compartment comprises connecting ports 56 for the supply water and electrical connections for at least driving the compressor 26. The second closeable opening 42 is closeable with a door 46, here shown as a container hatch 46.

According to embodiments in which the heat pump apparatus module is divided into two separate compartments (i.e. in embodiments where the second optional closeable compartment 36 is omitted), the connection ports 56, and any other equipment being described as comprised in the optional closeable compartment 36, may be arranged in the air-flow compartment 32, the first closeable compartment 34 and/or on the outside of the apparatus housing 10.

The housing 10 is arranged for housing the heat pump apparatus module 1. The housing 10 comprises the outer wall 12 and typically a floor 14 and a roof (not shown for clarity of illustration). The outer wall 12 at least partly circumferentially surrounds the heat pump arrangement 20. The outer wall 12 may be divided into separate portions corresponding to at least some of the separate compartments 32, 34, 36. Moreover, the outer wall 12 corresponding to the respective separate compartment 32, 34, 36 may be divided into subportions. The outer wall covering the air-flow compartment 32 is divided in three different subportions 60, 62, 64. In FIG. 1, a first subportion 60 being an air-intake is arranged in the outer wall 12 surrounding the air-flow compartment 32 on an opposite side to the first closeable compartment 34, and a second subportion 62 together with a third subportion 64, being air-outlets, are arranged in the outer wall 12 surrounding the air-flow compartment 32 on a respective lateral side of the housing 10. The subportion 60 comprises a lattice and/or grating 66. The subportions 62, 64 comprise means for directing the air-flow 68. According to at least one example embodiment of the invention the lattice and/or grating 66 may act as an opening to the air-flow compartment.

Moreover, the roof of the housing 10 may for example only cover at least one of the first and the second closeable units 34, 36 and hence allowing air flowing through the top of the air-flow compartment 32. In such embodiments, a fourth opening, being an air intake or an air outlet, is provided as an opening over at least a part of the air-flow compartment of the roof of the housing 10. Moreover, and which is further described with reference to FIG. 3*a*, the floor 14 of the housing 10 may be provided with an opening, for example being a fifth opening to the air-flow compartment 32. For example, the floor 14 of the air-flow compartment 32 may be comprised of a lattice or grating.

As shown in FIG. 1, the first closeable compartment 34 and the second closeable compartment 36 are accessible by different closeable openings 40, 42 in the housing 10. The first closeable compartment 34 is accessible by the closeable opening 40 which here is embodied by the container doors 44. Thus, a human (e.g. a service technician) may access the first closeable compartment 34 via the container doors 44, and preferably enter into the first closeable compartment 34 in order to review or repair any equipment within the first closeable compartment 34. Thus, it should be understood that the first closeable compartment 34 is typically adapted to be large enough for a human to enter. The second closeable compartment 32 is accessible by the closeable opening 42 which here is closeable by a container hatch 46. The container hatch 46 is typically a smaller door compared to the container doors 44, as the second closeable compartment 36 is typically smaller than the first closeable compartment 34. Thus, it should be understood that the second closeable compartment 36 is typically not adapted to be large enough for a human to enter, but rather large enough to house any connecting ports needed for the heat pump apparatus module 1.

As the first and the second closeable compartments 34, 36 are accessible via different closeable openings 40, 42, the accessibility to the first and the second closeable compartments 34, 36 may be adapted accordingly. For example, the first closeable opening 40 may be provided with a first type of access means, for example by a first lock in the container doors 44, which only the service technician has access to, while the second closeable opening 42 may be provided with a second type of access means, being different from the first type of access means, for example by a second lock in the container hatch 46, which only a person who connects the supply water and the electrical connections to the connection ports 56 has access to. Alternatively, also the service technician has access to the container hatch 46 and the second closeable compartment 36. In other words, the first closeable compartment 34 is accessible through a first level of access, and the second closeable compartment 36 is accessible through a second level of access.

The function of the heat pump apparatus module 1 of FIG. 1 will now be described in further detail.

The heat pump arrangement 20 utilizes the physical properties of a heat transferring medium that is typically an evaporating and condensing fluid often referred to as a refrigerant, which is led through a piping arrangement 54 in cycle from the evaporator 24 to the condenser 22 and back again. As stated above, it is the compressor 26 which is configured to transfer the heat transferring medium through the cycle, from the evaporator 24 to the condenser 22. Moreover, the compressor 26 is configured to change the pressure of the heat transferring medium and thereby increasing the thermal energy of the heat transferring medium. Thus, the compressor 26 compresses the heat transferring medium to make it relatively hotter in order to be able to utilize the heat on one side of the heat pump arrangement 20, i.e. the side to be warmed, here being inside the first closeable compartment 34. Subsequently, the heat transferring medium is throttled in order to reduce the pressure on another side of the heat pump arrangement 20, i.e. the side where heat is absorbed. In other words, the heat transferring medium is pressurized and circulated through the heat pump arrangement 20 by the compressor 26.

Stated differently, the heat pump arrangement 20 comprises a heat absorption side and a heat discharge side. On the heat absorption side, the heat transferring medium is typically at low pressure and is able to absorb heat from the surroundings, for the heat pump arrangement 20 in FIG. 1, this being the air flowing through the air-flow compartment 32. The air-flow compartment is typically configured to enable an air flow of at least 1000 $m^3$/h, or at least 10000 $m^3$/h, or at least 20000 $m^3$/h to flow through the air-flow compartment.

The heat absorption is carried out in the evaporator 24, i.e. the evaporator 24 is a first heat exchanger utilizing heat from the air to evaporate the heat transferring medium. After the evaporator 24, the heat transferring medium is compressed by the compressor 26 in order to raise the pressure and the temperature of the heat transferring medium. Subsequently, the heat transferring medium enters the heat discharge side, where the now hot and pressurized heat transferring medium, typically in the form of a vapor, is condensed in a second heat exchanger being the condenser 22. Thus, in the condenser 22, the heat absorbed in the heat absorption side is released to another medium, e.g. the supply water or another intermediate fluid, by means of heat exchange. The condensed heat transferring medium then typically passes through a pressure-lowering device or a throttling device, which also may be called a metering device, an expansion valve or capillary tube. The low pressure heat transferring medium then enters the evaporator and the cycle is repeated.

Thus, the evaporator 24 is configured to utilize the air flowing through the air-flow compartment 32 and to transfer the thermal energy from the air flowing through the air-flow compartment 32 to a heat transferring medium, led through piping 54, and the condenser 22 is configured to at least finally transfer the thermal energy from the heat transferring medium to the supply water.

Figure 2:
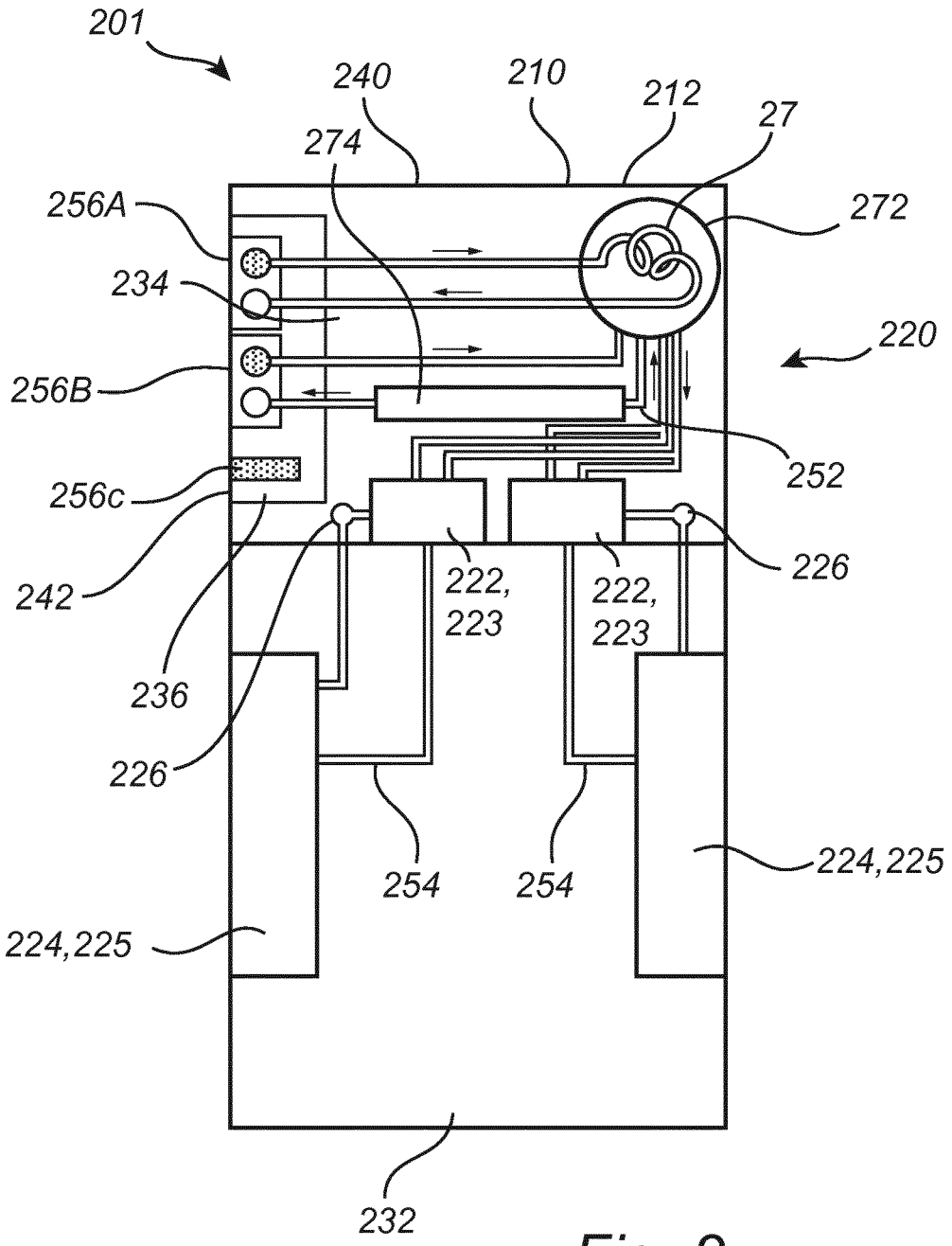
FIG. 2 is a schematic, top view of a heat pump apparatus module in accordance with at least one embodiment of the invention.

FIG. 2 shows a heat pump apparatus module 201, similar to the heat pump apparatus module 1 of FIG. 1, seen from above. The heat pump apparatus module 201 is configured for heating supply water, led through piping 252, in accordance with at least one example embodiment of the invention. The heat pump apparatus module 201 comprises an apparatus housing 210, here shown as a shipping container 210. Similar to the heat pump apparatus module 1 of FIG. 1, the apparatus housing 210 has an outer wall 212. The heat pump apparatus module 201 further comprises a heat pump arrangement 220 that comprises a condenser 222, an evaporator 224, and a compressor 226 with a similar set-up as the heat pump apparatus module 1 of FIG. 1 why the function of the heat pump arrangement 220 is not further described in relation to FIG. 2. As the heat pump apparatus module 201 of FIG. 2 is in large the same as the heat pump apparatus module 1 of FIG. 1 (e.g. the same reference numerals as in FIG. 1, with the addition of the value "200" is used for corresponding features in FIG. 2), focus on the description related to FIG. 2 will be on the differences compared to the heat pump apparatus module 1 of FIG. 1.

The heat pump apparatus module 201 of FIG. 2 is divided into three separate compartments 232,234,236:

- An air-flow compartment 232 which comprises two first heat pump components 225. In the embodiment of FIG. 2 each one of the first heat pump components 225 corresponds to an evaporator 224.
- A first closeable compartment 234 which is accessible through a first closeable opening 240 in the outer wall 212. The first closeable compartment 234 comprises two second heat pump components 223, which in the embodiment of FIG. 2 corresponds to a respective condenser 222. Moreover, the first closeable compartment comprises a supply water tank 272 and a water heater 274.
- A second closeable compartment 236 which is accessible through a second closeable opening 242 in the outer wall 212. The second closeable compartment comprises connecting ports 256A, 256B, 256C for the supply water (e.g. tap water to a first connection port 256A, heated radiator water to a second connection port 256B) and electrical connections (e.g. to a third connection port 256C) for at least driving the compressor 226.

As shown in FIG. 2, the two evaporators 224 are configured to utilize the air flowing through the air-flow compartment 232 and to transfer the thermal energy from the air flowing through the air-flow compartment to a heat transferring medium, led through piping 254, and subsequently discharge the absorbed heat in the two condensers 222.

In the condensers 222, the heat transferring medium is heat exchanged with a heat receiving medium, e.g. the supply water as shown in FIG. 2 (i.e. here either the tap water or the radiator water). As shown in FIG. 2, the supply water may be further heated in the heater 274.

According to at least one example embodiment, the heat receiving medium, e.g. the water which has been heated in the condenser(s), is acting as an intermediate heat carrier and is further heat exchanged in a separate heat exchanger with supply water, i.e. here either the tap water and/or the radiator water.

As also shown in FIG. 2, the supply water may be stored in a water tank 272. In other words, the water tank 272 may act as a heat reservoir for the supply water. The tank 272 may, when acting as a heat reservoir, level out or reduce the need for added extra peak power in the heat production. Inside the water tank there is water coils 276 which may be used for heat exchange.

Figure 3A:
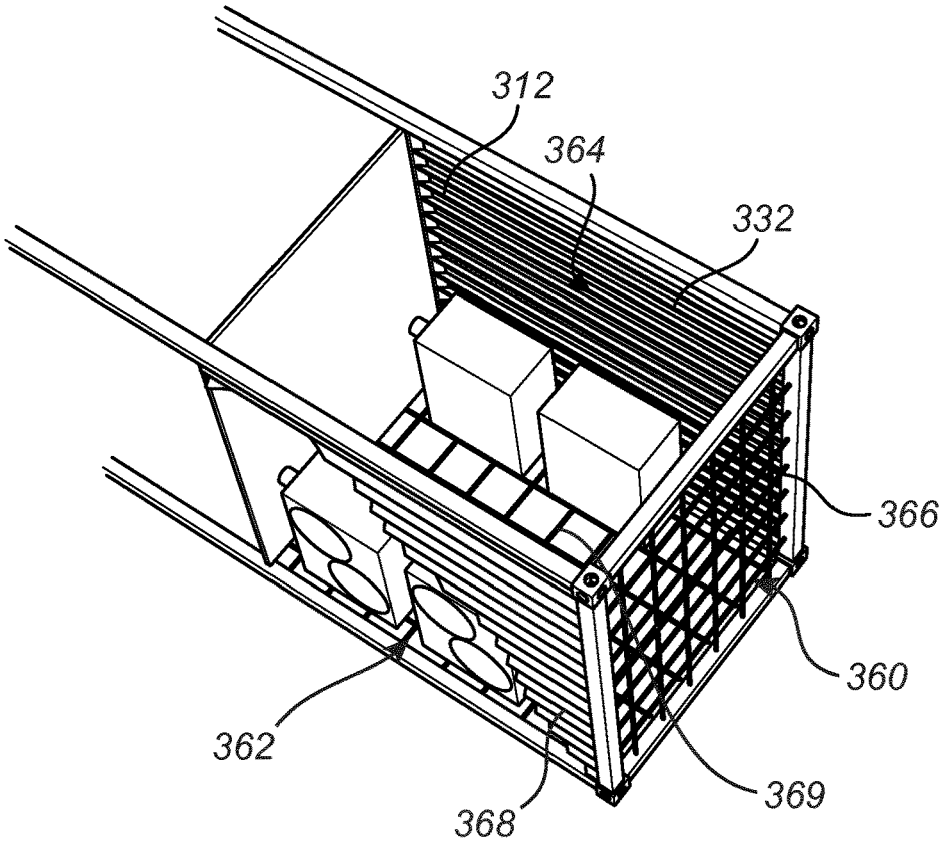
FIG. 3A is a schematic, perspective view of an air-flow compartment in accordance with at least one embodiment of the invention.

FIG. 3*a* shows an enlarged view of an air-flow compartment 332 according to at least one embodiment of the invention. The air-flow compartment 332 of FIG. 3 may be used as the air-flow compartment 32 of FIG. 1, or the air-flow compartment 232 of FIG. 2. As seen in FIG. 3*a*, at least a subportion 360 of the outer wall 312 surrounding the air-flow compartment 332 is comprised of a lattice 366 or a grating 366 enabling air to flow there-through. In other words, the air flow compartment 332 is at least partly surrounded by a lattice or grating 366 which covers at least a portion of an opening in the outer wall 312. The other subportions 362, 364 may be covered by means for directing the air-flow 368 out from the first heat pump component.

The lattice or grating 366 and/or the means for directing the air-flow 368 is configured to enable air to flow there-through and through the air-flow compartment 332. Moreover, the lattice or grating 366 and/or the means for directing the air-flow 368 hinder e.g. leafs or debris to enter the air-flow compartment 332. According to at least one example embodiment of the invention the lattice and/or grating 366 may act as an opening to the air-flow compartment.

According to at least one example embodiment, the heat pump apparatus module is configured to automatically remove any debris attached to the lattice or grating 366 and/or to the means for directing the air-flow 368. This may e.g. be carried out by a scrape which is configured to periodically sweep over the lattice or grating 366 and/or the means for directing the air-flow 368. Such scrape may e.g. be electrically driven and being connected to a processor configured to carry out computer-readable instructions with the periodically sweeping procedure. The automatically removal of any debris attached to the lattice or grating 366 and/or to the means for directing the air-flow 368 may alternatively be carried out by a reverse air-flow through the air-flow compartment 332. This may for example be carried out by reversing the function of the evaporators 24, 224 by a processor configured to carry out computer-readable instructions with the reversing function procedure.

In FIG. 3*a*, a drainage system 369 configured for removing moisture originating from an outer surface of the evaporators to an outside of the air-flow compartment 332 is shown. The drainage system 369 may comprise a lattice or grating on which the evaporators rest. The drainage system 369 is arranged for removing moisture originating from an outer surface of said first heat pump component to outside of said air-flow compartment.

Figure 3B:
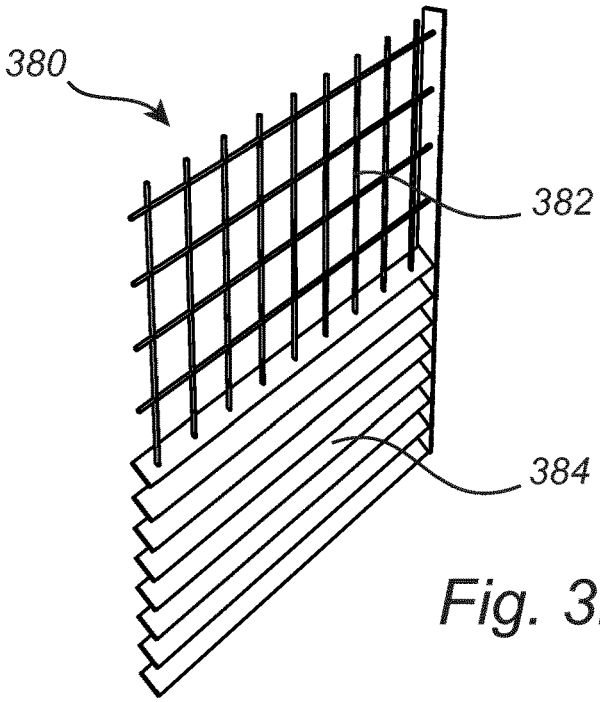
FIG. 3B is a schematic perspective view of an air-recirculation reducing arrangement in accordance with at least one embodiment of the invention.

FIG. 3*b* shows an air-recirculation reducing arrangement 380 which may be used instead of the lattice or grating 366 and/or to the means for directing the air-flow 368 in FIG. 3*a*. The air-recirculation reducing arrangement 380 is divided into an air-intake portion 382 and an air-outlet portion 384. The air-recirculation reducing arrangement 380 is configured such that air flowing through said air-flow compartment 332, via the air-intake portion 382 is brought into contact with said first heat pump component (typically the evaporator). The air-recirculation reducing arrangement 380 is further configured to prevent or at least reduce outlet air from the air-outlet portion 384 to be mixed with inlet air in the air-intake portion 382.

Figure 4:
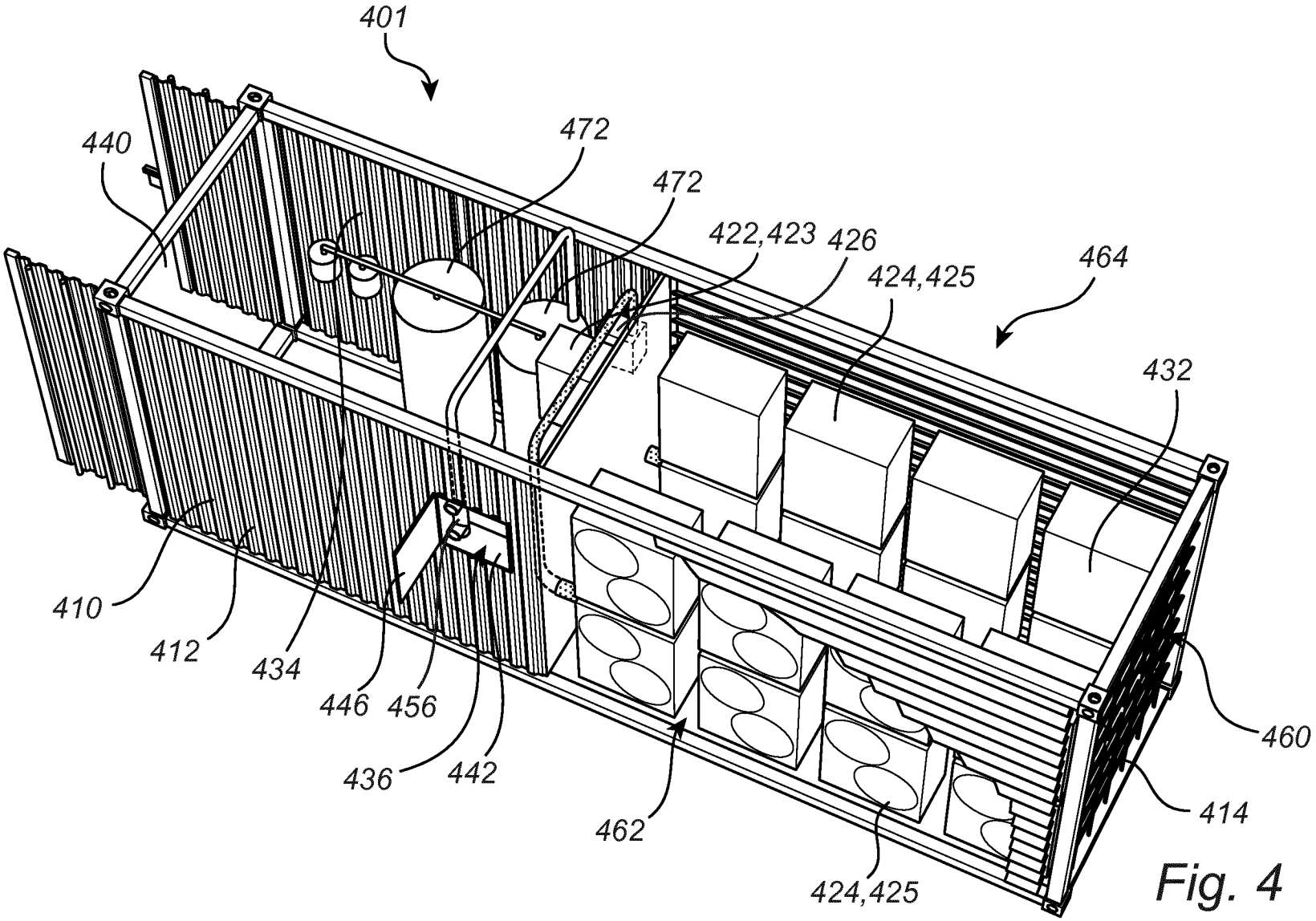
FIG. 4 is a schematic, perspective view of a heat pump apparatus module in accordance with at least one embodiment of the invention.

FIG. 4 shows a heat pump apparatus module 401, similar to the heat pump apparatus module 1 of FIG. 1 and the heat pump apparatus module 201 of FIG. 2. As the heat pump apparatus module 401 of FIG. 4 is in large the same as the heat pump apparatus modules 1, 201 of FIG. 1, respectively (e.g. the same reference numerals as in FIG. 1, with the addition of the value "400" is used for corresponding features in FIG. 4), focus on the description related to FIG. 4 will be on the differences compared to the heat pump apparatus modules land 201 of FIG. 1 and FIG. 2, respectively.

The heat pump apparatus module 401 comprises an apparatus housing 410, here shown as a larger shipping container 410 as compared with the shipping container 10 of FIG. 1 and 210 of FIG. 2 respectively. Consequently, the area of the three separate compartments 432,434,436 is larger and thereby more first and second heat pump components can be comprised in the heat pump apparatus module. Moreover, several water tanks, water heaters etc can be housed in the heat pump apparatus module. A larger heat pump apparatus module gives higher capacity.

In FIG. 4 the three separate compartments 432,434,436 comprises:

An air-flow compartment 432 which comprises 16 first heat pump components 425. In FIG. 4 each one of the first heat pump components 425 corresponds to an evaporator 424.

A first closeable compartment 434 which is accessible through a first closeable opening 440 in the outer wall 412. The first closeable compartment 434 comprises second heat pump components 423, which in FIG. 4 corresponds to the condenser 422. Moreover, the first closeable compartment comprises two supply water tanks 472.

A second closeable compartment 436 which is accessible through a second closeable opening 442 in the outer wall 412. The second closeable compartment comprises connecting ports 456 for the supply water and electrical connections for at least driving the compressor 426.

Figure 5:
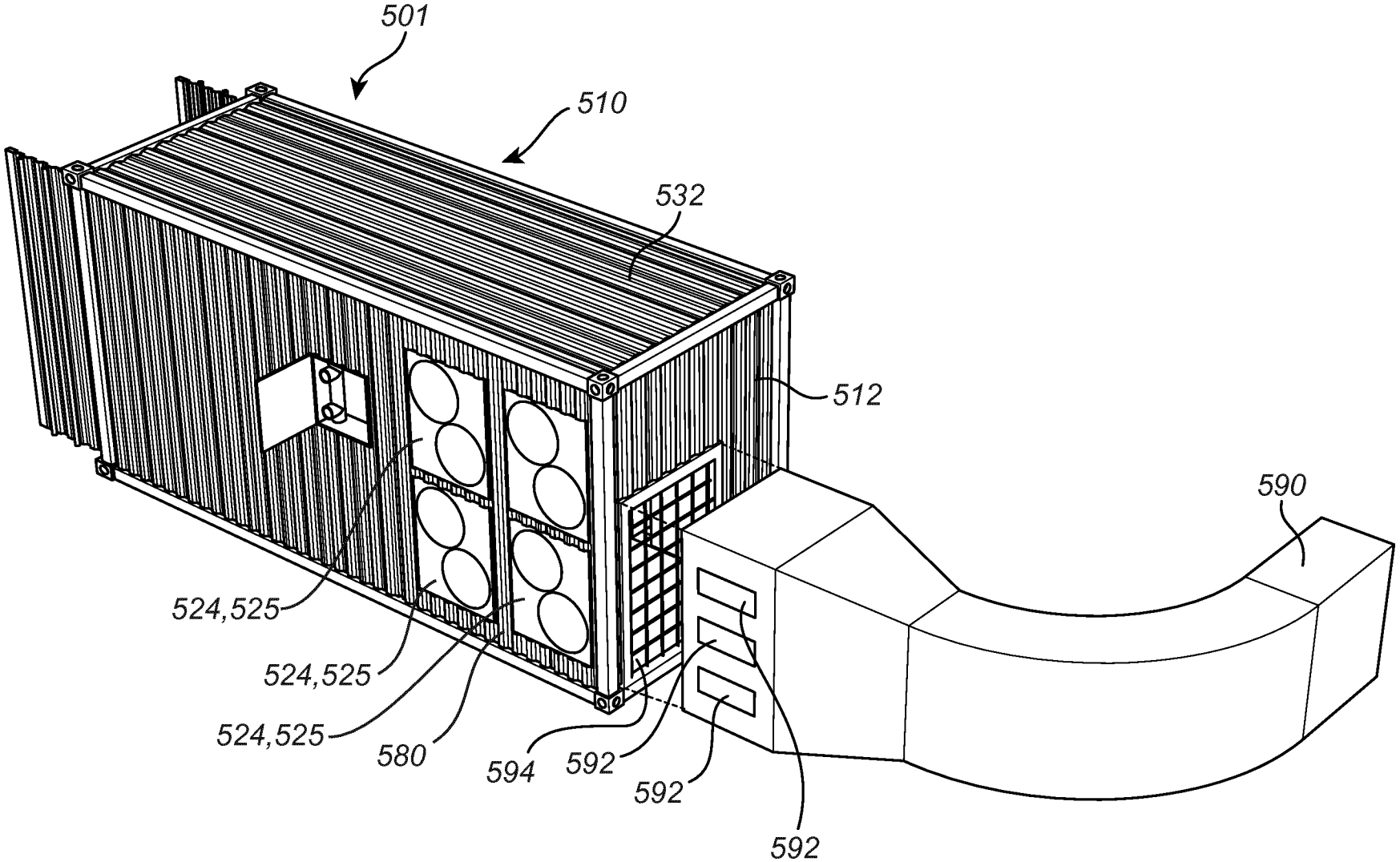
FIG. 5 is a schematic, perspective view of a heat pump apparatus module in accordance with at least one embodiment of the invention.

FIG. 5 shows a heat pump apparatus module 501, similar to the heat pump apparatus module 1 of FIG. 1. The heat pump apparatus module 501 is configured for heating supply water. The heat pump apparatus module 501 comprises an apparatus housing 510, here shown as a container 510 such as e.g. a shipping container. Similar to the heat pump apparatus module 1 of FIG. 1, the apparatus housing 510 has an outer wall 512. The heat pump apparatus module 501 further comprises a heat pump arrangement that comprises a condenser (not shown in FIG. 5), four evaporators 524, and a compressor (not shown in FIG. 5) with a similar, or equal, set-up as the heat pump apparatus module 1 of FIG. 1 why the function of the heat pump arrangement is not further described in relation to FIG. 5. As the heat pump apparatus module 501 of FIG. 5 is in large the same as the heat pump apparatus module 1 of FIG. 1 (e.g. the same reference numerals as in FIG. 1, with the addition of the value "500" is used for corresponding features in FIG. 5), focus on the description related to FIG. 5 will be on the differences compared to the heat pump apparatus module 1 of FIG. 1.

In connection to the heat pump apparatus module 501 a duct 590 is arranged. Through the duct 590, warm exhaust air from a house or a building is transported away from said house or building. The duct 590 is arranged in front of a duct facing opening 594, being an air-intake portion, of the air-flow compartment 532. The duct 590 may be arranged at a distance from the duct facing opening 594 as shown in FIG. 5 or it may be arranged adjacent, i.e. flush, to the duct facing opening 594 as indicated with the dashed lines. The duct 590 is configured to guide or transport the warm exhaust air from the house or building to enter the heat pump apparatus module 501 through the duct facing opening 594 and thereby facilitating the use of the heat pump apparatus module 501 for heat recovery purposes. The duct facing opening 594 is here covered by a lattice to hinder debris or unauthorized persons to enter the air-flow compartment 532. The duct 590 further comprises one or several side openings 592.

When the duct 590 is arranged at a distance from the duct facing opening 594, both exhaust air from the duct 590, and air from the surroundings may enter the air-flow compartment 532 via the duct facing opening 594.

When the duct 590 is arranged adjacent to the duct facing opening 594 and when the side openings 592 is closed, only exhaust air from a house or building may enter the air-flow compartment 532 via the duct 590. By opening the side openings 592 air from the surrounding is allowed to enter the air-flow compartment 532 via side openings 592 and duct facing opening 594. According to some embodiments, the side openings 592 are opened when there is no or a limited amount of exhaust air from a house of or a building. Further, the side openings 592 may be opened if the exhaust air from a house or a building is lower than the capacity of the heat pump apparatus module 501, i.e. the heat pump apparatus module 501 may have the capacity to use more air that what is provided by the house or the building.

The heat pump apparatus module 501 further comprises an air-recirculation reducing arrangement 580. The air-recirculation reducing arrangement 580 of the heat pump apparatus module 501 is a wall 580. The wall comprises openings for four evaporators 524. The wall 580 divides the air-flow compartment 532 into air-intake portion and an air-outtake portion. According to one example embodiment, the air-recirculation reducing arrangement further comprises the side openings 592 of the duct 590. That is, as the side openings 592 may be closed, especially for the embodiment when the duct 590 is arranged flushed the duct facing opening 594, they may reduce outlet air from entering the duct facing opening 594. Moreover, the duct 590 itself may be considered to be comprised in the air-recirculation reducing arrangement, especially for the embodiment when the duct 590 is arranged flushed the duct facing opening 594, as the duct 590 reduce or prevents outlet air from entering the duct facing opening 594. In embodiments where the duct 590 and/or the side openings 592 of the duct 590 is/are comprised in the air-recirculation reducing arrangement, the wall 580 may be omitted.

During operation, air is entering the air-flow compartment 532. The air may be exhaust air from a house or a building, and/or it may be air from the surroundings of the heat pump apparatus module 501. The air enters the air-flow compartment 532 through the duct facing opening 594. The air, which has entered the air-flow compartment 532 comes in contact with a first side of the evaporators 524, passes through the evaporators 524 and exit the evaporators on the other side of the wall 580. Hence, the wall 580 separates the air which enters the air-flow compartment 532, i.e. the inlet air, from the air which exits the same, i.e. the outlet air, and thereby is mixture of outlet air and inlet air prevented or at least reduced.

The skilled person realizes that a number of modifications of the embodiments described herein are possible without departing from the scope of the invention, which is defined in the appended claims.

For instance, the invention is not limited to heating supply water. For instance, the invention can be used for cooling supply water. In that case, the condensor is being the first heat pump component and the evaporator is being the second heat pump component. The first and second heat pump components are typically not physically replaced with each other, but the function of the respective first and second heat pump components are decided based on the desired direction of transferring heat. The heat pump apparatus module may be equipped with separate connections for cooling water and one or several tanks for cooled water. Moreover, two or more heat pump arrangement may be used. The two or more heat pump arrangements may be used simultaneously for heating and cooling.

Moreover, debris may alternatively be removed from the lattice or grating and/or the means for directing the air-flow by an additional blow-system.

What is claimed is:

1. A heat pump apparatus module for heating and/or cooling supply water, said heat pump apparatus module comprising:

an apparatus housing being at least partly provided with an outer wall;

a heat pump arrangement comprising a condenser, an evaporator, and a compressor arranged between said condenser and said evaporator, said compressor being configured to transfer a heat transferring medium from said evaporator to said condenser;

wherein said heat pump apparatus module is divided into at least two separate compartments being:

an air-flow compartment comprising a first heat pump component being either the condenser or the evaporator, the air-flow compartment being configured to allow air to flow therethrough, said first heat pump component being configured to utilize said air for heating or cooling said heat transferring medium;

a first closeable compartment being accessible through a first closeable opening, and wherein said air-flow compartment comprises an air-intake portion and an air-outlet portion, configured such that air flowing through said air-flow compartment is brought into contact with said first heat pump component, said heat pump apparatus module further comprising an air-recirculation reducing wall configured to prevent or at least reduce, outlet air from the air-outlet portion to be mixed with inlet air in the air-intake portion, wherein the heat pump apparatus module comprises a control system configured to receive a heating demand signal and a cooling demand signal from a building or a construction site;

wherein said heating demand signal is indicative of a heating demand in said building or construction site and said cooling demand signal is indicative of a cooling demand in said building or construction site, and wherein said control system is responsive to at least one of said heating demand signal and said cooling demand signal such that said control system is configured to control said heat pump to perform at least one of: cool said supply water when said control system receives said cooling demand signal and heat said supply water when said control system receives said heating demand signal, such that said heat pump apparatus satisfies the heating demand or the cooling demand from the building or the construction site.

2. The heat pump apparatus module according to claim 1, wherein said compressor is arranged in said first closeable compartment.

3. The heat pump apparatus module according to claim 1, wherein said first heat pump component is the evaporator, thereby enabling said supply water to be heated by said heat pump arrangement.

4. The heat pump apparatus module according to claim 1, wherein said first heat pump component is the condenser, thereby enabling said supply water to be cooled by said heat pump arrangement.

5. The heat pump apparatus module according to claim 1, wherein said air-flow compartment is configured to enable an air flow of at least 1000 $m^3$/h, or at least 10000 $m^3$/h, or at least 20000 $m^3$/h, through said air-flow compartment.

6. The heat pump apparatus module according claim 1 further comprising a drainage system for removing moisture originating from an outer surface of said first heat pump component to outside of said air-flow compartment.

7. The heat pump apparatus module according to claim 1, wherein said apparatus housing is a shipping container.

8. The heat pump apparatus module according to claim 1, wherein at least a portion of the outer wall surrounding said air-flow compartment is comprised of a lattice or grating enabling air to flow there-through.

9. The heat pump apparatus module according to claim 8, wherein said heat pump apparatus module is configured to automatically remove any debris attached to said lattice or grating.

10. The heat pump apparatus module according to claim 1, wherein said heat pump apparatus module is divided into at least three separate compartments, wherein said third separate compartment is:

a second closeable compartment being accessible through a second closeable opening, said second closeable compartment comprising connecting ports for the supply water and electrical connections for at least driving the compressor.

11. The heat pump apparatus module according to claim 10, wherein said first closeable compartment is accessible through a first level of access, and wherein said second closeable compartment is accessible through a second level of access being different to said first level of access.

12. The heat pump apparatus module according to claim 11, wherein said first level of access is associated with a first security level, and said second level of access is associated with a second security level different from said first security level, thereby authorizing persons with different level of security access to enter the first and the second closeable compartments, respectively.

13. The heat pump apparatus module according to claim 1, wherein said air-recirculation reducing wall is arranged to separate said air-outlet portion and said air-intake portion.

14. The heat pump apparatus module according to claim 13, wherein said air-recirculation reducing wall at least partly surrounds said air-flow compartment; and wherein said air-intake portion is at least one opening in said air-recirculation reducing wall.

15. The heat pump apparatus module according to claim 14, wherein said heat pump apparatus module further comprises a duct provided for transporting exhaust gas from a house or a building; and wherein said at least one opening in said air-recirculation reducing wall is a duct facing opening and wherein said duct is arranged in front of and/or in close proximity of said duct facing opening.

16. The heat pump apparatus module according to claim 1, wherein said apparatus housing is a container having a length, a width and a height;

wherein the length of said container is between 8 ft and 45 ft, and/or wherein the width of said container is between 8 ft and 10 ft; and/or wherein the height of said container is between 8 ft and 10 ft.

17. The heat pump according to claim 16, wherein the length of said container is between 10 ft and 40 ft.

18. The heat pump according to claim 17, wherein the length of said container is between 20 ft and 40 ft.

19. A heat pump apparatus module for heating supply water, said heat pump apparatus module comprising:

an apparatus housing being at least partly provided with an outer wall;

a heat pump arrangement comprising a condenser, an evaporator, and a compressor arranged between said condenser and said evaporator, said compressor being configured to transfer a heat transferring medium from said evaporator to said condenser;

wherein said heat pump apparatus module is divided into at least two separate compartments being:

an air-flow compartment comprising a first heat pump component being either the condenser or the evaporator, the air-flow compartment being configured to allow air to flow therethrough, said first heat pump component being configured to utilize said air for heating said heat transferring medium;

a first closeable compartment being accessible through a first closeable opening, and wherein said air-flow compartment comprises an air-intake portion and an air-outlet portion, configured such that air flowing through said air-flow compartment is brought into contact with said first heat pump component, said heat pump apparatus module further comprising an air-recirculation reducing wall configured to prevent or at least reduce, outlet air from the air-outlet portion to be mixed with inlet air in the air-intake portion, and wherein the heat pump apparatus module comprises a control system configured to receive a heating demand signal from a building or a construction site;

wherein said heating demand signal is indicative of a heating demand in said building or construction site; and wherein said control system is responsive to said heating demand signal such that said control system is configured to control said heat pump to heat said supply water when said control system receives said heating demand signal, such that said heat pump apparatus satisfies a heating demand from the building or the construction site.

20. A building or construction site heating and/or cooling system comprising:

a building or construction site;

a heat pump apparatus module for cooling supply water, said heat pump apparatus module comprising:

an apparatus housing being at least partly provided with an outer wall;

a heat pump arrangement comprising a condenser, an evaporator, and a compressor arranged between said condenser and said evaporator, said compressor being configured to transfer a heat transferring medium from said evaporator to said condenser;

wherein said heat pump apparatus module is divided into at least two separate compartments being:

an air-flow compartment comprising a first heat pump component being the condenser, the air-flow compartment being configured to allow air to flow therethrough, said first heat pump component being configured to utilize said air for cooling said heat transferring medium;

a first closeable compartment being accessible through a first closeable opening, and wherein said air-flow compartment comprises an air-intake portion and an air-outlet portion, configured such that air flowing through said air-flow compartment is brought into contact with said first heat pump component, said heat pump apparatus module further comprising an air-recirculation reducing wall configured to prevent or at least reduce, outlet air from the air-outlet portion to be mixed with inlet air in the air-intake portion, and wherein the heat pump apparatus module comprises a control system configured to receive a heating demand signal and a cooling demand signal from said building or said construction site;

wherein said heating demand signal is indicative of a heating demand in said building or construction site and said cooling demand signal is indicative of a cooling demand in said building or construction site and wherein said control system is responsive to at least one of said heating demand signal and said cooling demand signal such that said control system is configured to control said heat pump to perform at least one of cool said supply water when said control system receives said cooling demand signal and heat said supply water when said control system receives said heating demand signal such that said heat pump apparatus satisfies the cooling demand from the building or the construction site.

* * * * *